US008147360B2

(12) United States Patent
Simo et al.

(10) Patent No.: US 8,147,360 B2
(45) Date of Patent: Apr. 3, 2012

(54) SERRATED BLADE FOR ARROWHEAD

(75) Inventors: Miroslav A. Simo, Riverside, IL (US); Robert S. Mizek, Downers Grove, IL (US)

(73) Assignee: New Archery Products Corp., Forest Park, IL (US)

( * ) Notice: Subject to any disclaimer, the term of this patent is extended or adjusted under 35 U.S.C. 154(b) by 227 days.

(21) Appl. No.: 12/455,456

(22) Filed: Jun. 2, 2009

(65) Prior Publication Data

US 2010/0299942 A1 Dec. 2, 2010

(51) Int. Cl.
*F42B 6/08* (2006.01)

(52) U.S. Cl. ..... 473/583; 30/355

(58) Field of Classification Search ..... 30/346.55, 30/346.56, 355, 357; 473/582, 583, 584
See application file for complete search history.

(56) References Cited

U.S. PATENT DOCUMENTS

| | | | | | |
|---|---|---|---|---|---|
| 386,183 | A | * | 7/1888 | Brooks | 30/355 |
| 592,961 | A | * | 11/1897 | Brooks | 30/355 |
| 1,497,577 | A | * | 6/1924 | Morzsa | 30/503.5 |
| 1,710,142 | A | * | 4/1929 | Berg | 83/849 |
| 2,691,527 | A | * | 10/1954 | Ramsey | 473/583 |
| 2,799,930 | A | * | 7/1957 | Champlin | 30/355 |
| 2,820,637 | A | * | 1/1958 | La Foud | 473/583 |
| 3,279,065 | A | * | 10/1966 | Senkewitz | 30/355 |
| 4,006,901 | A | | 2/1977 | Simo | |
| 4,093,230 | A | | 6/1978 | Simo | |
| 4,175,749 | A | | 11/1979 | Simo | |
| 4,203,601 | A | | 5/1980 | Simo | |
| 4,234,191 | A | * | 11/1980 | Erlandson | 473/583 |
| 4,380,340 | A | | 4/1983 | Simo | |
| 4,381,866 | A | | 5/1983 | Simo | |
| 4,529,208 | A | | 7/1985 | Simo | |
| 4,676,512 | A | | 6/1987 | Simo | |
| D314,416 | S | * | 2/1991 | Rezmer | D22/115 |
| D355,469 | S | * | 2/1995 | Lothe | D22/115 |
| 5,390,936 | A | * | 2/1995 | Westenburg | 473/584 |
| 5,564,713 | A | | 10/1996 | Mizek et al. | |
| 5,787,591 | A | * | 8/1998 | Lu | 30/355 |
| 5,871,410 | A | | 2/1999 | Simo et al. | |
| 5,941,784 | A | | 8/1999 | Mizek | |
| 6,398,676 | B1 | | 6/2002 | Mizek | |
| 6,554,727 | B1 | * | 4/2003 | Armstrong et al. | 473/584 |
| 6,739,991 | B1 | * | 5/2004 | Wardropper | 473/578 |
| 7,025,697 | B2 | | 4/2006 | Mizek et al. | |
| 7,037,222 | B2 | | 5/2006 | Mizek et al. | |
| 7,232,390 | B2 | | 6/2007 | Mizek et al. | |
| 7,338,397 | B2 | | 3/2008 | Mizek et al. | |
| 2009/0111621 | A1 | | 4/2009 | Mizek | |
| 2009/0203477 | A1 | | 8/2009 | Mizek et al. | |

OTHER PUBLICATIONS

Hellfire Series Heads (1 page)—http://www.steelforce.com/products/hellfire.html (Retrieved Feb. 10, 2011).

Broadheads 1871-1971—Identification and Rarity Guide for the Most Collectible Antique Archery Broadheads (17 pages)—http://www.ArcheryCollectibles.com.

* cited by examiner

*Primary Examiner* — John Ricci
(74) *Attorney, Agent, or Firm* — Pauley Petersen & Erickson

(57) ABSTRACT

A serrated blade for an arrowhead, a crossbow bolt and/or another suitable projectile. The blade has a first blade surface that intersects with a second blade surface to form at least one cutting edge. The blade also has a mixed serration section of at least one small serration and at least one large serration. The mixed serration section is positioned adjacent to at least one cutting edge. The serrated configuration of this invention allows the blade to cut in a saw-like manner as the blade passes in a forward direction through a target material.

16 Claims, 6 Drawing Sheets

SERRATED BLADE FOR ARROWHEAD

BACKGROUND OF THE INVENTION

1. Field of the Invention

This invention relates to a blade for an archery arrowhead or for a crossbow bolt, wherein a cutting section has serrations for cutting through relatively tough target material or animal material.

2. Discussion of Related Art

Many conventional arrowheads have blades with teeth, notches or serrations, for cutting through relatively tough materials, such as animal hides and animal bones.

Many conventional arrowhead blades that have a straight cutting edge with no teeth, notches or serrations will break or otherwise significantly dull upon impact with relatively tough materials, such as bone material. Upon target impact, an edge of some conventional blades will peen or roll over and thus dull the blade. Impact with bone material can also cause arrowheads to undesirably steer or deflect away from an intended flight path. A misguided arrow can result in only seriously wounding but not expiring an animal.

There is an apparent need for an arrowhead blade that can easily pass through relatively tough target material, such as animal hides, animal bones and animal muscle tissue, particularly without dulling the cutting edge or changing the direction or course of the arrowhead and the attached arrow shaft.

SUMMARY OF THE INVENTION

A serrated blade for an arrowhead, a crossbow bolt or any other similar projectile that has a head structure with one or more blades, can be used to better cut through relatively tough target materials or animal structural components. According to this invention, two blade surfaces intersect or meet with each other to form a cutting edge. In some embodiments of this invention, the cutting edge forms two or more straight or relatively straight sections that are similar to many conventional straight blades for arrowheads.

Blades according to this invention also include a mixed serration section. The mixed serration section can extend along at least a portion of a length of the cutting edge. Depending upon the particular cutting results desired, different configurations of straight sections and serrated sections can be configured or arranged along a cutting edge of the blade.

The mixed serration sections of the blade according to this invention can have many different sizes and/or shapes that result in different cutting capabilities. In some embodiments of this invention, one or more larger serrations can be positioned next to or adjacent one or more smaller serrations. In some embodiments of this invention, the mixed serration section is positioned adjacent at least one straight cutting edge.

The straight section or straight cutting edge can help to cleanly cut animal material, for example, whereas a serrated section can help tear or saw through tough target material or animal material. If for some reason a clean cut is not desired, then according to some embodiments of this invention, an entire length of the blade cutting edge can have the mixed serration section, with no straight cutting edge or straight section.

Although the blade of this invention is particularly useful for arrowheads, crossbow bolts and/or other similar projectiles, the blade according to this invention can also be used in any other structure, apparatus or device that is used to cut through material, particularly relatively tough material.

BRIEF DESCRIPTION OF THE DRAWINGS

The above and other features and objects of this invention are better understood from the following detailed description taken in view of the drawings wherein.

DETAILED DESCRIPTION OF THE INVENTION

Figure 1:
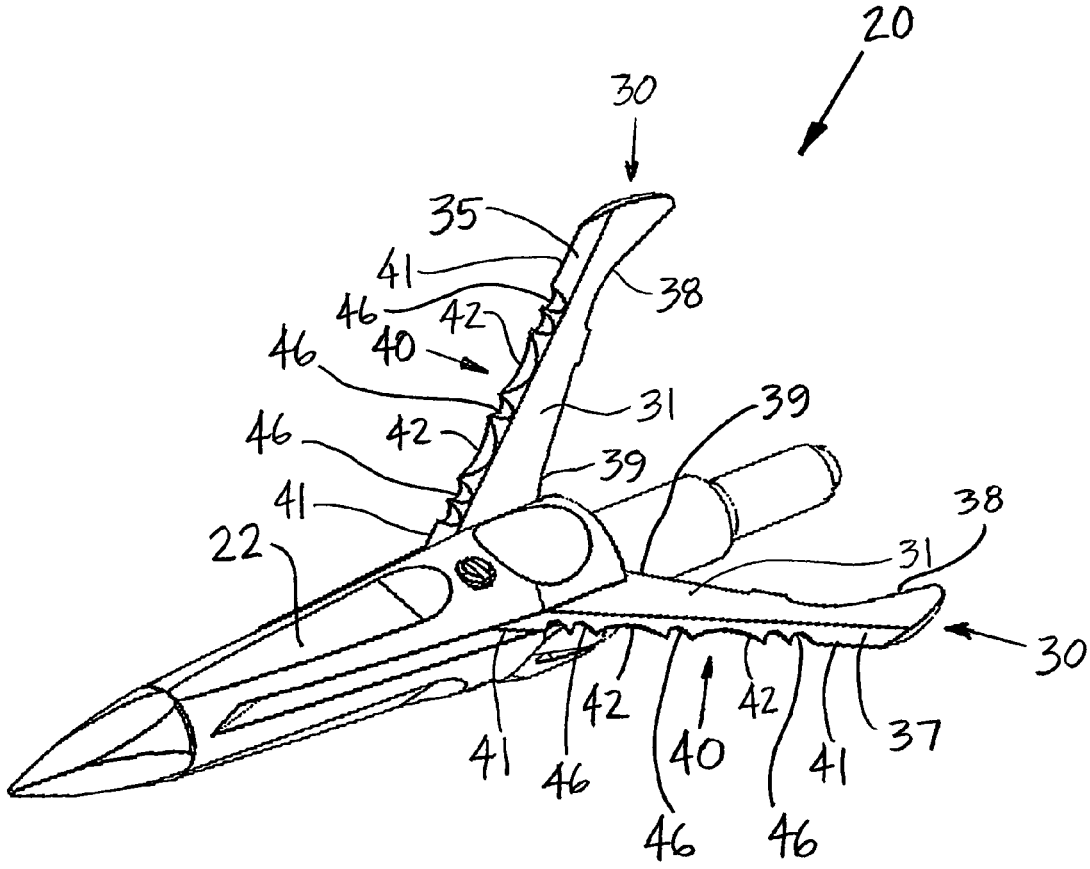
FIG. 1 is a perspective view of a mechanical or blade-opening arrowhead having blades that pivot with respect to a ferrule body, according to one embodiment of this invention.
Figure 2:
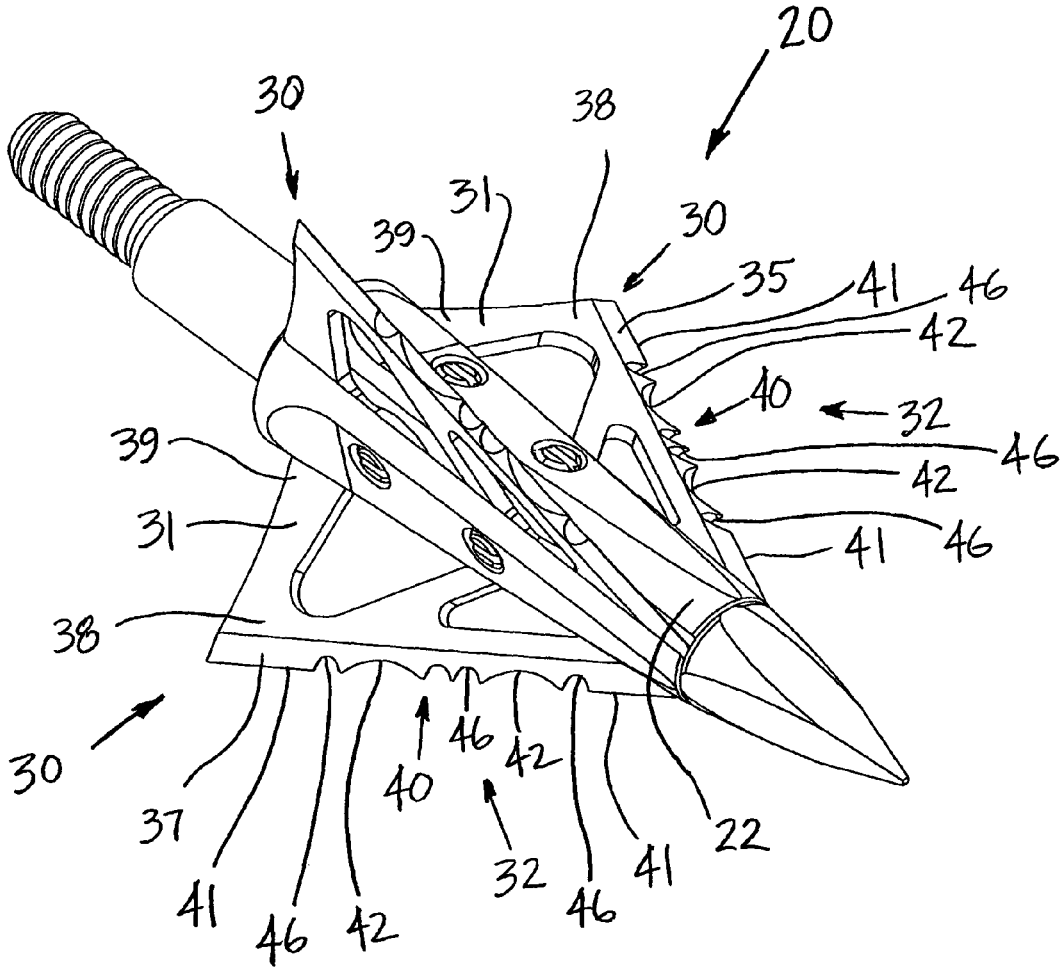
FIG. 2 is a perspective view of an arrowhead having blades that are stationary or fixed with respect to the ferrule body, according to another embodiment of this invention.

FIGS. 1 and 2 show perspective views of different types of arrowheads having serrated blades 30, according to different embodiments of this invention. FIG. 1 shows each blade 30 pivotally mounted with respect to ferrule 22 of arrowhead 20. As shown in FIG. 2, each blade 30 is detachably fixed with respect to ferrule 22. Any other suitable configuration of an arrowhead, a crossbow bolt and/or any other similar projectile, can be used to fixedly or moveably mount blade 30 with respect to a body or other structure of arrowhead 20.

U.S. Pat. Nos. 5,941,784 and 4,381,866 each describes a mechanical arrowhead or a fixed blade arrowhead, respectively, and the entire teachings of U.S. Pat. Nos. 5,941,784 and 4,381,866 are incorporated into this specification by reference.

As shown in FIGS. 1-4 and 6, blade 30 has one mixed serration section 40, which differs from straight section 41. Straight blade sections are found on many conventional arrowhead blades. The interrupted or non-uniform cutting surface of mixed serration section 40 of this invention can be used to develop or generate a relatively higher level of localized pressure, such as when blade 30 impacts or otherwise contacts target material. As used throughout this specification and in the claims, the term target material is intended to relate to any relatively tough or rough material of a stationary target or a moving target, such as an animal, and is also intended to include bone material, organ material, hide material, muscle material or any other material found within an animal or another moving or stationary target.

Conventional blades of arrowheads have teeth, notches or serrations uniformly positioned along a cutting surface, which cut through target material but also tend to undesirably load with pieces of the target material, as the arrowhead passes through the target. Other conventional arrowheads have blades with relatively larger uniformly spaced teeth, notches or serrations, which do not load as much with small pieces of the target material but rather are so large that the target material is not properly cut. According to some embodiments of this invention, mixed serration section 40 comprises a combination of smaller serrations and larger serrations, which can better provide a back-and-forth sawing action, even though blade 30 passes the target material in one direction. Mixed serration section 40 according to this invention allows blade 30 to travel in one direction and act or cut like a hand saw that uses a back-and-forth motion.

Figure 3:
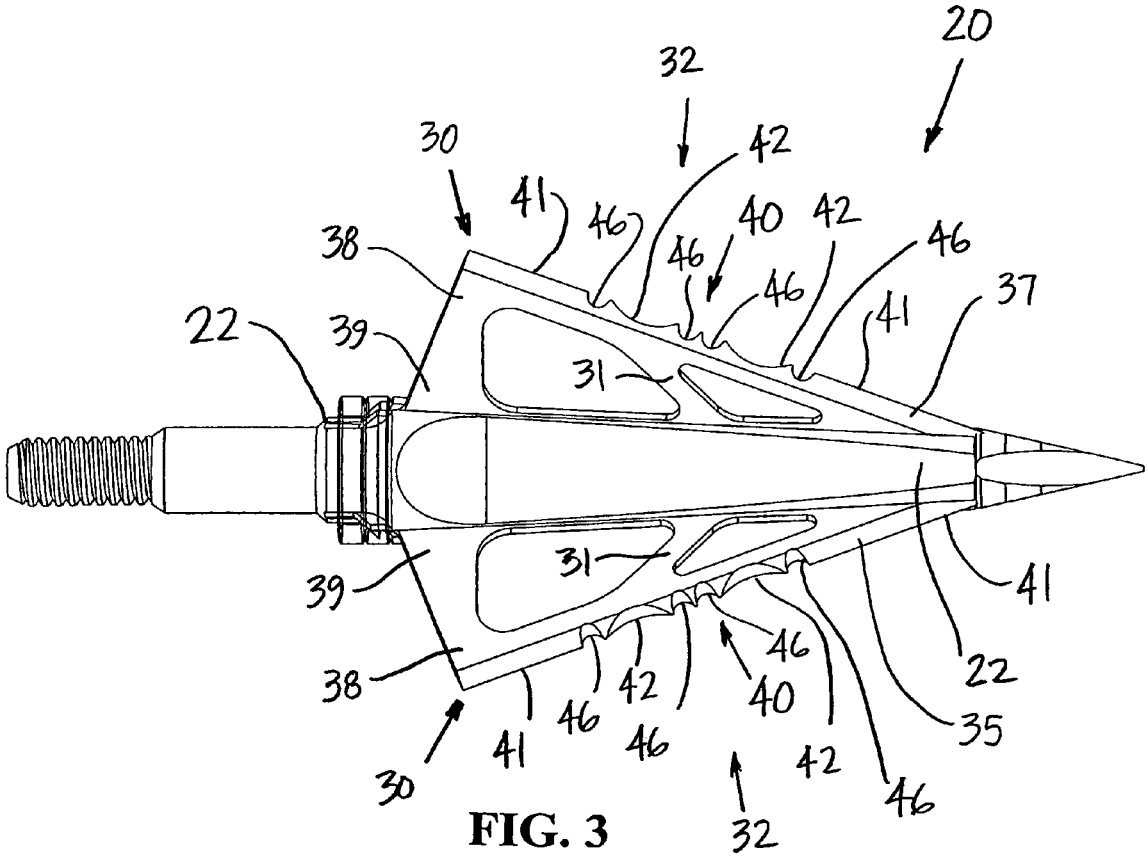
FIG. 3 is a side view of the arrowhead as shown in FIG. 2.
Figure 4:
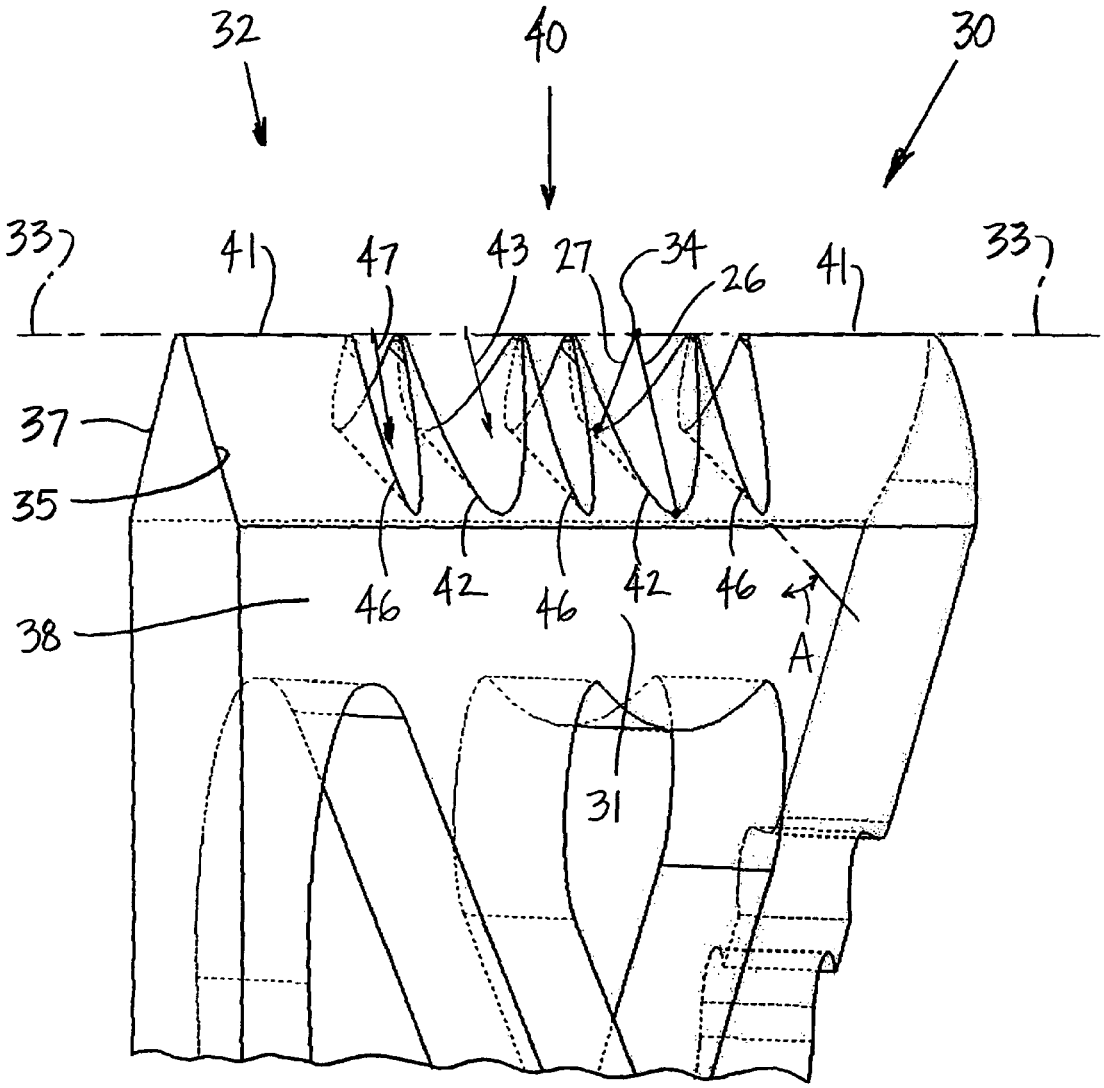
FIG. 4 is a perspective partial view of a section of a blade, according to one embodiment of this invention.
Figure 5:
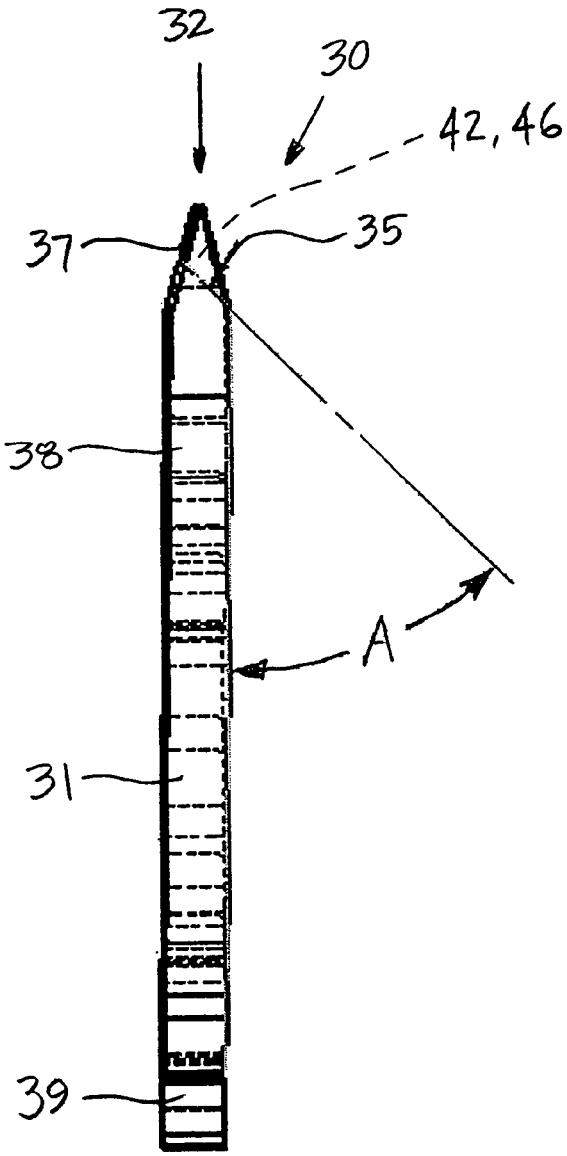
FIG. 5 is a front view of a blade, according to one embodiment of this invention.
Figure 6:
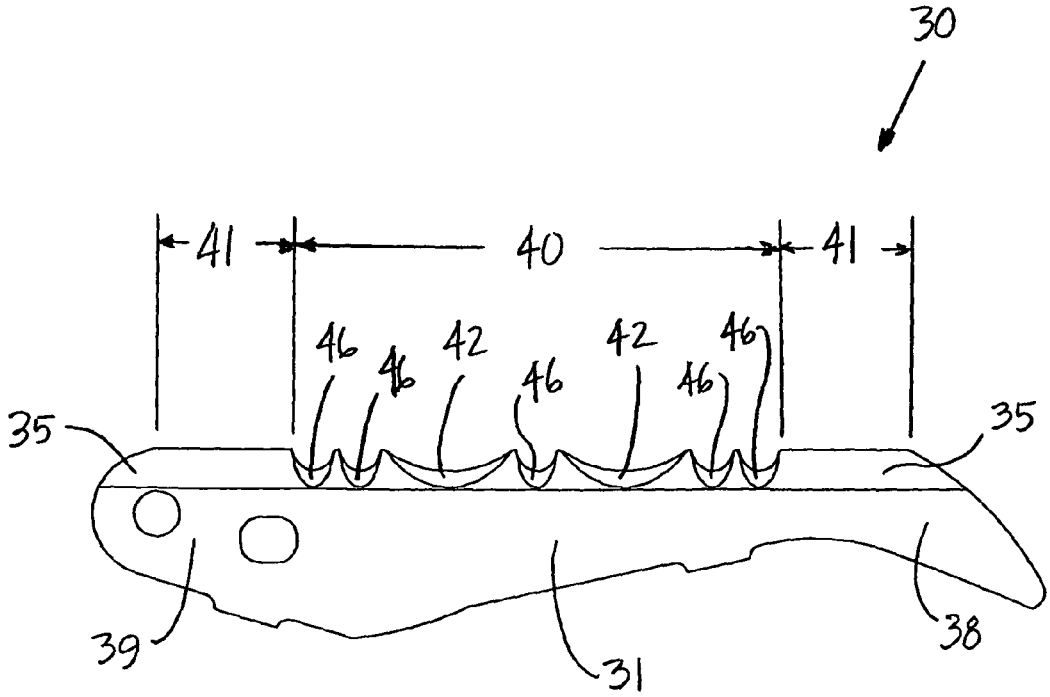
FIG. 6 is a side view of a blade, according to another embodiment of this invention.

As shown in FIGS. 1-6, blade 30 comprises blade surface 35 and blade surface 37. In some embodiments according to this invention, such as shown in FIGS. 4 and 5, blade surface 35 is positioned at an angle A with respect to blade surface 37. At least a portion of blade surface 35 intersects with a portion of blade surface 37 to form at least one cutting edge 32, such as shown in FIG. 4. In some embodiments according to this invention, cutting edge 32 forms a relatively straight edge section, such as those found in conventional arrowhead blades. As shown in FIGS. 1 and 2, each blade 30 has straight section 41 of cutting edge 32 positioned at outer portion 38 and also at inner portion 39. In other embodiments of this invention, there can be only one straight section 41 of cutting edge 32 or three or more straight sections 41 of cutting edge 32.

As shown in FIG. 4, cutting edge 32 is positioned or generally located along cutting line 33. In some embodiments of this invention, such as shown in FIG. 4, from point 34 on cutting line 33, large serration 42 extends further into blade surface 35 than into blade surface 37. Thus, the distance of line 26 as shown in FIG. 4 is greater than the distance of line 27. The dimensions and shape of large serration 42 and/or small serration 46 can be varied to result in a different shape on blade surface 35 than on blade surface 37.

In some embodiments according to this invention, radius of curvature 43 and/or radius of curvature 47 can be generated within body 31 by rotating a cylindrical tool at an acute angle with respect to a general plane defined by body 31 of blade 30.

Large serration 42 and/or small serration 46 can have a cross section of a circular arc or of a non-circular arc, such as a cross section of a hyperbolic function. With a circular section, radius of curvature 43 and/or radius of curvature 47 is constant along a surface of the corresponding serration 42, 46. With a non-circular cross section of large serration 42 and/or small serration 46, radius of curvature 43 and/or radius of curvature 47 has a variable radius along a surface of the corresponding serration 42, 46.

In certain embodiments according to this invention, radius of curvature 47 of small serration 46 has a dimension or area that is less than radius of curvature 43 of large serration 42.

As shown in FIG. 1, each mixed serration section 40 has two adjacent small serrations 46 positioned next to or adjacent each of the two straight sections 41 of cutting edge 32, that are positioned at or near outer portion 38 and innerportion 39. In a direction toward a center of cutting edge 32, each mixed serration section 40 has one large serration 42. One small serration 46 is positioned between both large serrations 42. FIGS. 2 and 3 show a different configuration of large serrations 42 and small serrations 46 within mixed serration section 40. Any other suitable arrangement of or linear combination of large serrations 42 and small serrations 46 can be used to accomplish different cutting or penetrating results with blade 30 of this invention.

The number, size and/or shape of large serration 42 and/or small serration 46 can be varied to accomplish different cutting and/or tearing results. More small serrations 46 can positioned adjacent or next to each other to form an overall relatively fine set of teeth. However, in that configuration although each tooth carries a relatively light load, the wasted target material can undesirably clog the relatively fine teeth. Likewise, relatively large serrations 42 can be used in situations where each tooth carries a relatively higher load, but not as many teeth or large serrations 42 can fit within a same length of cutting edge 32.

As shown in FIGS. 1 and 2, straight section 41 or a non-serrated section of cutting edge 32 is positioned at both outer portion 38 and inner portion 39. This particular arrangement can allow blade 32 to cleanly cut the target material upon entry of blade 30 into the target material. As blade 30 moves further into the target, mixed serration section 40 can be used to saw or form a jagged cut that tends to tear or rip the target material. And then the straight section at outer portion 38 can be used to stop the tearing or ripping action by the jagged cut and form a cleaner or more surgical cut, so that as blade 30 completes its path through the target material the cut is a relatively clean cut. In animal targets, a clean cut can prevent blood from clotting, which is preferred in some hunting situations.

In some embodiments according to this invention, blade surface 35 and/or blade surface 37 is generally planer. In other embodiments according to this invention, blade surface 35 and/or blade surface 37 is generally curved or non-planar. It is also possible to have both planer and non-planar sections of blade surface 35 and/or blade surface 37.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

What is claimed is:

1. A blade for an arrowhead, the blade comprising:

a body having a first blade surface and a second blade surface, at least a portion of said first blade surface intersecting with at least a portion of said second blade surface to form at least one cutting edge, a mixed serration section of at least one first serration each having a first length positioned adjacent at least one second serration each having a second length less than said first length, said mixed serration section positioned adjacent a straight section of at least one cutting edge, and said at least one first serration having a first radius of curvature, and said at least one second serration having a second radius of curvature that is less than said first radius of curvature.

2. The blade according to claim 1, wherein said mixed serration section includes at least two said second serrations.

3. The blade according to claim 1, wherein said mixed serration section includes at least one alternating serrations pattern of two said second serrations adjacent each other and adjacent said first serration.

4. The blade according to claim 1, wherein said mixed serration section includes at least one alternating serrations pattern of two said second serrations adjacent each other and adjacent said first serration.

5. The blade according to claim 1, wherein a first said cutting edge is positioned at an outer portion of said body and a second said cutting edge is positioned at an inner portion of said body.

6. The blade according to claim 5, wherein said mixed serration section includes at least two adjacent said second serrations positioned next to a straight section of said at least one cutting edge.

7. The blade according to claim 6, wherein at least one said first serration is positioned between each pair of said two said second serrations.

8. The blade according to claim 1, wherein said first blade surface and/or said second blade surface is generally planar.

9. The blade according to claim 1, wherein said at least one cutting edge is positioned along a cutting line, and from a point on said cutting line each said first serration extends further into said first blade surface than into said second blade surface.

10. The blade according to claim 1, wherein said at least one cutting edge is positioned along a cutting line, and from a point on said cutting line each said second serration extends further into said first blade surface than into said second blade surface.

11. A blade for an arrowhead, the blade comprising:

a body having a first blade surface and a second blade surface, at least a portion of said first blade surface intersecting with at least a portion of said second blade surface to form at least one cutting edge, a mixed serration section of at least one first serration each having a first length positioned adjacent at least one second serration each having a second length less than said first length, said mixed serration section positioned adjacent a straight section of at least one cutting edge, and said at least one cutting edge positioned along a cutting line, and from a point on said cutting line each said first serration extending further into said first blade surface than into said second blade surface.

12. The blade according to claim 11, wherein said at least one first serration has a first radius of curvature, and said at least one second serration has a second radius of curvature that is less than said first radius of curvature.

13. The blade according to claim 12, wherein said at least one cutting edge is positioned along a cutting line, and said first radius of curvature and/or said second radius of curvature is within a plane containing said cutting line.

14. A blade for an arrowhead, the blade comprising:

a body having a first blade surface and a second blade surface, at least a portion of said first blade surface intersecting with at least a portion of said second blade surface to form at least one cutting edge, a mixed serration section of at least one first serration each having a first length positioned adjacent at least one second serration each having a second length less than said first length, said mixed serration section positioned adjacent a straight section of at least one cutting edge, and said at least one cutting edge positioned along a cutting line, and from a point on said cutting line each said second serration extending further into said first blade surface than into said second blade surface.

15. A blade for an arrowhead, the blade comprising:

a body having a first blade surface and a second blade surface, at least a portion of said first blade surface intersecting with at least a portion of said second blade surface to form at least one cutting edge, a mixed serration section of at least one first serration each having a first length positioned adjacent at least one second serration each having a second length less than said first length, said mixed serration section positioned adjacent a straight section of at least one cutting edge, a first said cutting edge positioned at an outer portion of said body and a second said cutting edge positioned at an inner portion of said body, said mixed serration section including at least two adjacent said second serrations positioned next to a straight section of said at least one cutting edge, two said first serrations each positioned between each pair of said two said second serrations, and at least one said second serration positioned between both said first serrations.

16. A blade for an arrowhead, the blade comprising:

a body having a first blade surface and a second blade surface, at least a portion of said first blade surface intersecting with at least a portion of said second blade surface to form at least one cutting edge, a mixed serration section of at least one first serration each having a first length positioned adjacent at least one second serration each having a second length less than said first length, said mixed serration section positioned adjacent a straight section of at least one cutting edge, and said first blade surface and/or said second blade surface is generally curved.

* * * * *